US009074605B2

(12) United States Patent
Bouru et al.

(10) Patent No.: US 9,074,605 B2
(45) Date of Patent: Jul. 7, 2015

(54) TURBINE ENGINE COMPRESSOR HAVING AIR INJECTIONS

(75) Inventors: Michel André Bouru, Montereau sur le Jard (FR); Laurent Jablonski, Melun (FR); Armel Touyeras, Combs la Ville (FR)

(73) Assignee: SNECMA, Paris (FR)

( * ) Notice: Subject to any disclaimer, the term of this patent is extended or adjusted under 35 U.S.C. 154(b) by 800 days.

(21) Appl. No.: 13/393,367

(22) PCT Filed: Aug. 20, 2010

(86) PCT No.: PCT/FR2010/051744

§ 371 (c)(1),
(2), (4) Date: Apr. 23, 2012

(87) PCT Pub. No.: WO2011/023891

PCT Pub. Date: Mar. 3, 2011

(65) Prior Publication Data

US 2012/0201654 A1 Aug. 9, 2012

(30) Foreign Application Priority Data

Aug. 31, 2009 (FR) ..... 09 55922

(51) Int. Cl.
*F04D 29/40* (2006.01)
*F04D 27/02* (2006.01)
(Continued)

(52) U.S. Cl.
CPC ..... *F04D 27/0207* (2013.01); *F04D 29/4213* (2013.01); *F04D 29/522* (2013.01)

(58) Field of Classification Search
CPC ..... F04D 27/0207; F04D 27/023; F04D 27/0238; F04D 29/522; F04D 29/4213; F04D 29/682; F04D 29/684; F01D 1/12; F01D 9/06; F01D 9/065; F01D 17/12; F01D 17/105; F05D 2270/101
USPC ..... 415/57.1–57.4, 58.5, 58.7, 58.1, 59.1, 415/144
See application file for complete search history.

(56) References Cited

U.S. PATENT DOCUMENTS 3,011,762 A * 12/1961 Pouit ..... 415/109
4,097,188 A * 6/1978 Forster ..... 415/202
(Continued)

FOREIGN PATENT DOCUMENTS

| | | |
|---|---|---|
| EP | 0 526 965 | 2/1993 |
| WO | 98 16747 | 4/1998 |
| WO | 2006 090152 | 8/2006 |

OTHER PUBLICATIONS

International Search Report Issued Nov. 5, 2010 in PCT/FR10/51744 Filed Aug. 20, 2010.

*Primary Examiner* — Nathaniel Wiehe
*Assistant Examiner* — Eldon Brockman
(74) *Attorney, Agent, or Firm* — Oblon, McClelland, Maier & Neustadt, L.L.P.

(57) ABSTRACT

A turbine engine compressor, including a first housing for supporting injectors, a second housing arranged around the first housing while forming with the first housing an annular space therewith, and a plurality of air injectors each mounted in recesses. Each air injector includes at least one inner air injection channel which leads, on one side, into an outflow jet of the gas stream and, on the other side, into the space formed between the recesses, and, at an upstream end, an upstream rim having an inner surface radially bearing against an upstream rim of the corresponding recess of the first housing and an outer surface radially bearing against an inner surface of the second housing. A mechanism clamping the upstream rim of the air injectors between the housings enables the air injectors to be held in position in the recesses of the first housing.

7 Claims, 3 Drawing Sheets

(51) Int. Cl.
*F04D 29/42* (2006.01)
*F04D 29/52* (2006.01)

(56) References Cited

U.S. PATENT DOCUMENTS 5,246,335 A 9/1993 Mitsubori et al.
5,474,417 A * 12/1995 Privett et al. ..... 415/58.5
5,607,284 A * 3/1997 Byrne et al. ..... 415/58.5
8,152,445 B2 * 4/2012 Guemmer ..... 415/58.5
2006/0104805 A1 * 5/2006 Gummer ..... 415/58.5
2006/0153673 A1 7/2006 Guemmer
2008/0056882 A1 3/2008 Clay et al.
2009/0252596 A1 * 10/2009 Guemmer ..... 415/115

* cited by examiner

TURBINE ENGINE COMPRESSOR HAVING AIR INJECTIONS

BACKGROUND OF THE INVENTION

The present invention relates to the general field of turbine engine compressors. It more particularly relates to a high pressure turbine engine compressor in which air recirculation is provided aiming at limiting the pumping phenomenon.

A turbine engine compressor comprises several successive compression stages, each compression stage consisting of a row (or grid) of fixed vanes followed by a row of mobile vanes. An annular housing surrounds the rows of vanes and delimits on the outside the outflow jet of the airflow passing through the compressor.

Such a compressor is subject to pumping. The pumping is a phenomenon for which minimization is sought within a turbine engine since this is expressed by sudden oscillations of the air pressure and of the airflow rate, which subject the vanes of the compressor to considerable mechanical stresses which may lead to their embrittlement, or even to their failure. This phenomenon notably occurs at the vane head, at the limiting air layer present between the head of the vanes and the housing of the compressor and is locally expressed by lower pressure pockets.

One of the solutions known for minimizing this phenomenon is to provide air recirculation within the compressor. For this purpose, air is generally taken from the outflow jet of the compressor at right angles (or just downstream) to the head of mobile vanes of a compressor stage. This taken air then transits into a conduit before being re-injected more upstream in the outflow jet, for example upstream and towards the head of mobile vanes of another stage of the compressor. For example, reference may be made to documents US 2005/0226717 and U.S. Pat. No. 5,474,417 which describe exemplary embodiments of such air recirculation.

The re-injection of air taken from the outflow jet is generally accomplished by means of air injectors which are mounted in recesses provided for this purpose on the housing surrounding the vanes. Typically, these air injectors are parts regularly spaced out angularly from each other and each provided with an internal air injection channel opening out, on one side into the outflow jet of the compressor, and on the other side towards an air supply conduit connected to the air recirculation circuit.

Maintaining these air injectors in position on the housing of the compressor poses problems. Indeed, known solutions either consist of mounting the air injectors in their recess by a tight adjustment of the H7p6 type, or of immobilizing the air injectors in their recess by means of screws. Now, the mounting of the air injectors by tight adjustment has the main drawback of making it impossible to disassemble these injectors without causing damages to the housing. As to maintaining the injectors by means of screws, application problems are posed as regards the size and the number of required screws (one to two screws per air injector), without counting the occupied space which would need to be available for inserting a self-braking means on the housing.

OBJECT AND SUMMARY OF THE INVENTION

The main object of the invention is therefore to overcome such drawbacks by proposing a compressor in which maintaining the air injectors in position is reliable while keeping the possibility of being able to disassemble them.

This object is achieved by means of a turbine engine compressor, comprising:

a first housing forming a support of injectors centered on a longitudinal axis of the compressor and delimiting on the outside an outflow jet of a gas flow passing through the compressor;

a second housing centered on the longitudinal axis of the compressor and positioned around the first housing by making with the latter an annular space; and a plurality of air injectors each mounted in recesses with a matching shape, formed at one longitudinal end upstream from the first housing and regularly spaced out from each other, each air injector having:

at least one internal air injection channel opening out radially, on one side into the outflow jet of the gas flow passing through the compressor and on the other side into the annular space formed between the housings, and at an upstream longitudinal end, an upstream rim having an inner surface radially bearing against an upstream rim of the corresponding recess of the first housing and an outer surface radially bearing against an inner surface of the second housing;

means for clamping the upstream rim of the air injectors between the housings in order to maintain the air injectors in position in the recesses or the first housing.

The invention has the advantage of providing that the whole of the air injectors are maintained in position in their respective recess by simple mechanical clamping of the injectors between both housings. In the absence of tight adjustments in the assembly, it is thereby possible to be able to replace the air injectors without causing any damages to the housings. The result of this is simplified maintenance.

Advantageously, the first housing comprises bosses formed between the recesses and the outer surface of which protrudes relatively to the outer surface of the first housing on the one hand, and is set back relatively to the outer surfaces of the upstream rims of the air injectors on the other hand, the clamping means comprising at least one attachment screw which radially crosses the second housing and which is screwed onto one of the bosses of the first housing.

Each air injector may further comprise at one downstream longitudinal end, a downstream rim having an inner surface radially bearing against a downstream rim of the corresponding recess of the first housing. In this case, advantageously each air injector also comprises side rims connecting the upstream rim to the downstream rim, these side rims each having an inner surface radially bearing against a side rim of the corresponding recess of the first housing. The presence of these side rims gives the possibility of avoiding any form of parasitic introduction of air intended for injection through a route other than that defined by the internal air injection channels.

The object of the invention is also a turbine engine comprising a compressor as defined earlier, the latter may be a high pressure compressor of the turbine engine.

SHORT DESCRIPTION OF THE DRAWINGS

Other features and advantages of the present invention will become apparent from the description made below, with reference to the appended drawings which illustrate an exemplary embodiment thereof without any limiting nature. In the figures.

DETAILED DESCRIPTION OF EMBODIMENTS

Figure 1:
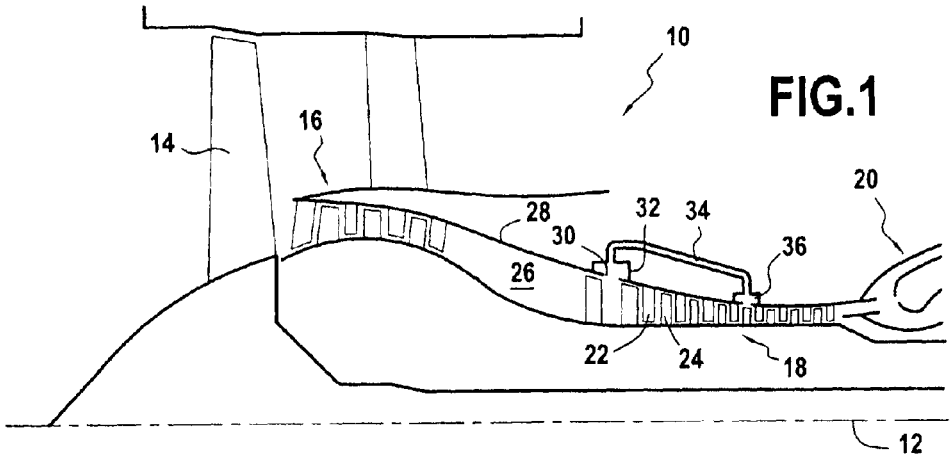
FIG. 1 is a longitudinal sectional view showing schematically and in its environment a high pressure compressor of a turbine engine according to the invention.

FIG. 1 partly illustrates a turbine engine 10 with a longitudinal axis 12. From upstream to downstream (in the flow direction of the gas streams which cross it), the turbine engine comprises a fan 14, a low pressure compressor 16, a high pressure compressor 18, a combustion chamber 20 and a turbine (not shown).

Each compressor, and in particular the high pressure compressor 18, includes several compression stages, each stage consisting of a row (or grid) of fixed vanes 22, followed by a row of mobile vanes 24. These rows of vanes 22, 24 are positioned in an outflow jet 26 of the airflow crossing the compressor, this jet being radially delimited on the outside by an annular cover 28.

In order to minimize the pumping phenomenon within the high pressure compressor 18, provision is made for taking up from the jet 26 a fraction of the air crossing the compressor in order to re-inject it further upstream into the jet.

For this purpose, the cover 28 surrounding the rows of vanes 22, 24 of the compressor include one or several apertures 30 opening into the jet 26 (at right angles to or just downstream from the head of mobile vanes of a stage of the compressor) and opening out into an annular diffusion conduit 32 centered on the longitudinal axis 12 and surrounding the cover.

This diffusion conduit 32 is connected via one or several tubes 34 to an annular sampling conduit 36, also centered on the longitudinal axis 12. The diffusion conduit 32 opens out upstream into the jet 26, for example, towards the head of mobile vanes of another stage of the compressor, via a plurality of air injectors 38 as described hereafter in connection with FIGS. 2 to 5.

Figure 3:
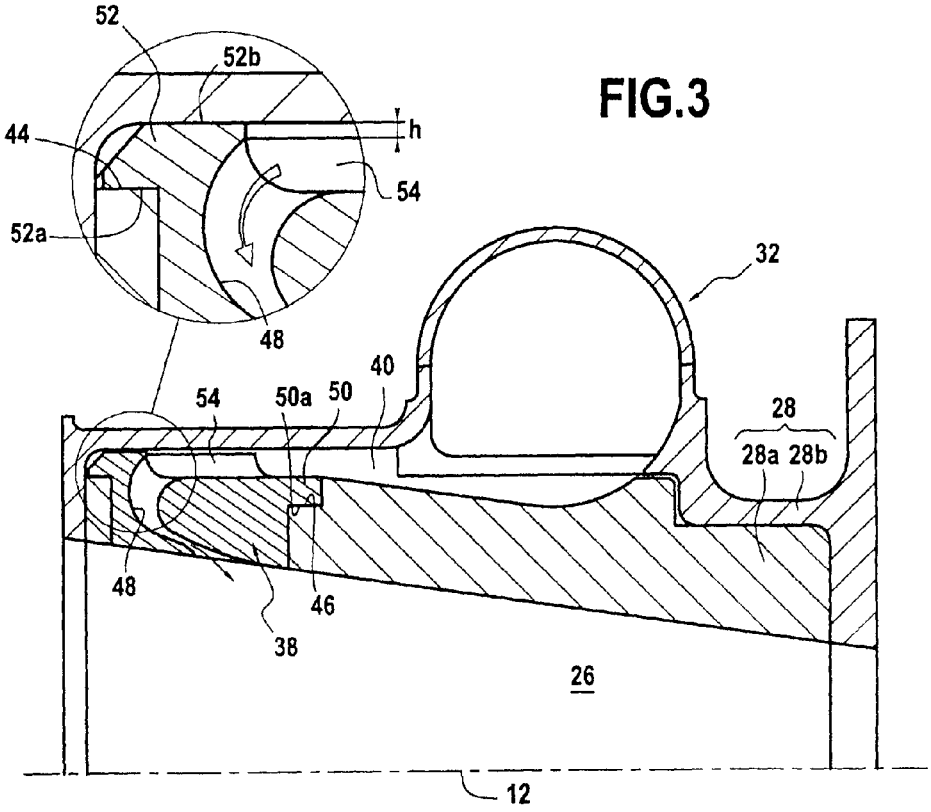
FIGS. 3 and 4 are sectional views of the assembled compressor of FIG. 2, along III-III and IV-IV respectively.
Figure 2:
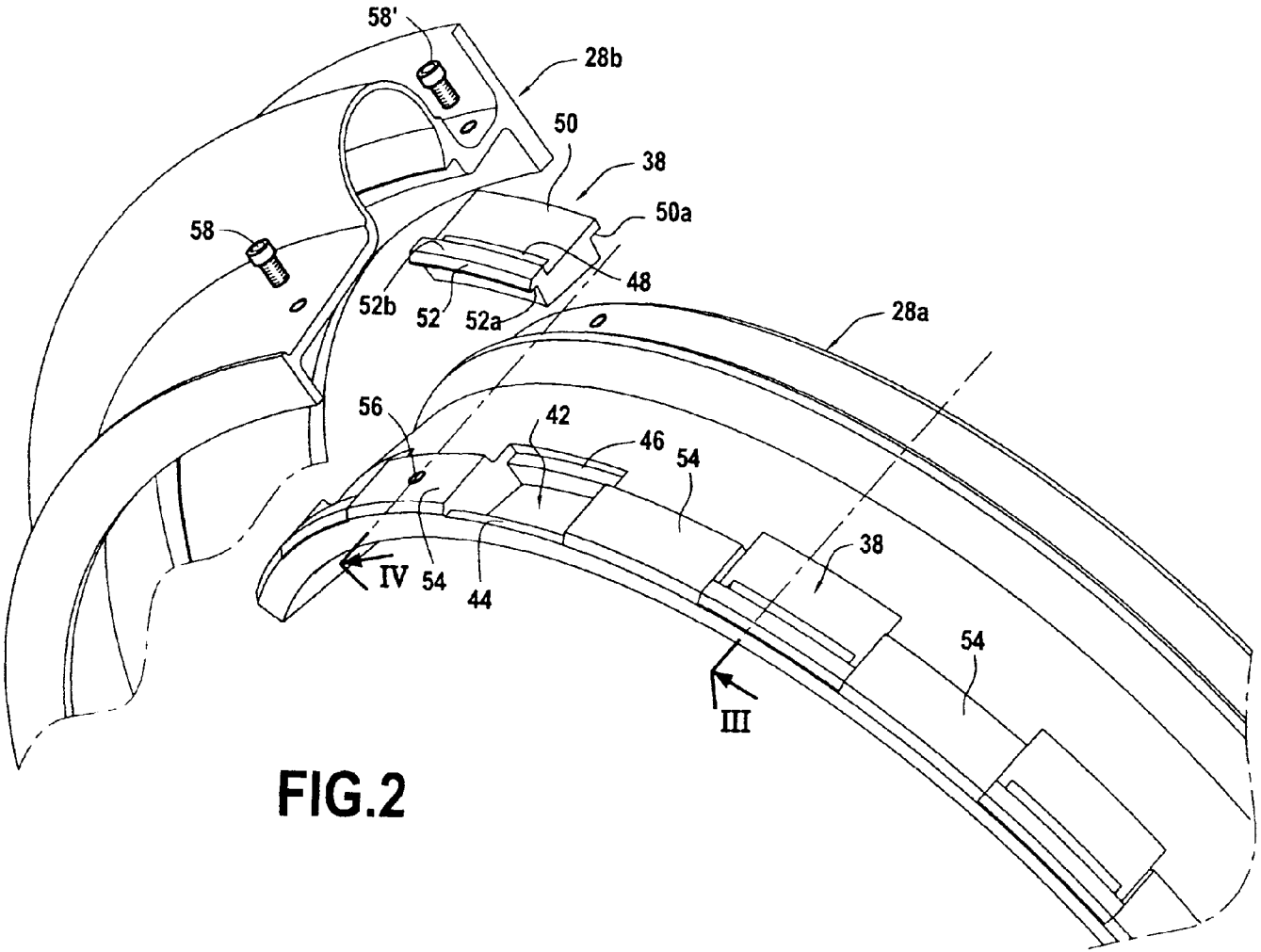
FIG. 2 is a partial, perspective and exploded view of the compressor according to the invention.
Figure 4:
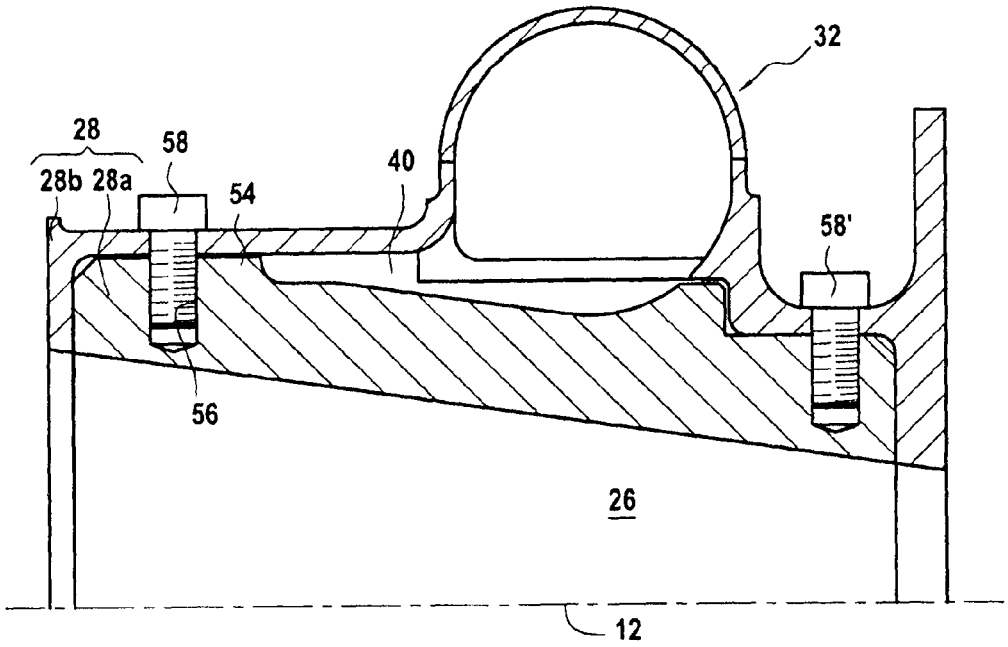

As illustrated in FIGS. 2 to 4, the cover 28 surrounding the rows of vanes of the compressor consist of a first housing 28*a* forming a support for the injectors and a second housing 28*b* positioned around the first housing. The first housing 28*a* is segmented, i.e. it consists of a plurality of annular housing segments placed end to end.

Both of these housings 28*a*, 28*b* are centered on the longitudinal axis 12 of the turbine engine and are radially spaced apart from each other in order to arrange between them an annular space 40 which opens out into the diffusion conduit 32.

At its upstream end (relatively to the direction of flow of the gas flow crossing the compressor) the first housing 28*a* includes a plurality of recesses 42 regularly spaced apart from each other, each recess 42 having an upstream rim 44 and a downstream rim 46. The air injectors 38 are mounted in these recesses.

Each air injector 38 comprises at least one internal channel 48 for injecting air which opens out radially, on one side into the outflow jet 26 of the gas flow crossing the compressor and on the other side into the annular space 40 formed between the housings 28*a*, 28*b*. This air injection channel is therefore supplied with air through the diffusion conduit 32.

Moreover, each air injector 38 comprises at its downstream longitudinal end, a downstream rim (or spoiler) 50, the inner surface 50*a* of which bears against the downstream rim 46 of the corresponding recess of the first housing.

Each air injector 38 also comprises at its upstream longitudinal end, an upstream rim (or spoiler) 52 having an inner surface 52*a* radially bearing against the upstream rim 44 of the matching recess of the first housing and an outer surface 52*b* radially bearing against an inner surface of the second housing 28*b*.

These rims 50, 52 give notably the possibility of participating in the radial positioning of the injectors 38 on the first housing 28*a* and form obstacles to parasitic passage of the air through a path other than the one provided by the internal air injection channels 48.

According to the invention, the air injectors 38 are maintained in position in their respective recesses 42 of the first housing 28*a* by means for clamping their upstream rim 52.

For this purpose, as illustrated in FIG. 2, the first housing 28*a* comprises bosses 54 which are formed at the upstream end between the recesses 42 of the air injectors. These bosses have an outer surface which radially protrudes relatively to the outer surface of the first housing on the one hand and is set back radially relatively to the outer surface 52*b* of the upstream rims 52 of the air injectors on the other hand.

In other words, the outer surface 52*b* of the upstream rims 52 of the air injectors radially protrudes relatively to the bosses 54 of the first housing when the air injectors are mounted in their recesses (this difference in level is schematized by the dimension h in FIG. 3.) Moreover, at least one of these bosses has a tapped bore hole 56.

As illustrated in FIG. 4, a fixing screw 58 which radially crosses the second housing 28*b* right through is screwed into this hole 56. This screw allows the second housing 28*b* to be attached onto the first housing 28*a*. It also allows the housings 28*a*, 28*b* to exert a radial clamping force on the upstream rim 52 of each air injector 38 mounted in the recesses 42 of the first housing. Indeed, as the upstream rim 52 of the air injectors 38 radially protrudes relatively to the bosses 54, it is easily understood that the tightening of the fixing screw 58 will cause a clamping force on these upstream rims between the inner surface of the second housing 28*b* and the respective upstream rim 44 of the recesses of the first housing 28*a*. Thus, the whole of the air injectors 38 of the compressor are held in position between both housings 28*a*, 28*b*.

It will be noted that the number of fixing screws 58 may vary, preferably the latter are regularly distributed over the whole circumference of the compressor. Further, additional fixing screws 58' may also be screwed through the second housing 28*b* at the downstream end of the latter (see FIG. 4).

In connection with FIG. 5, another embodiment of the compressor according to the invention will now be described.

Figure 5:
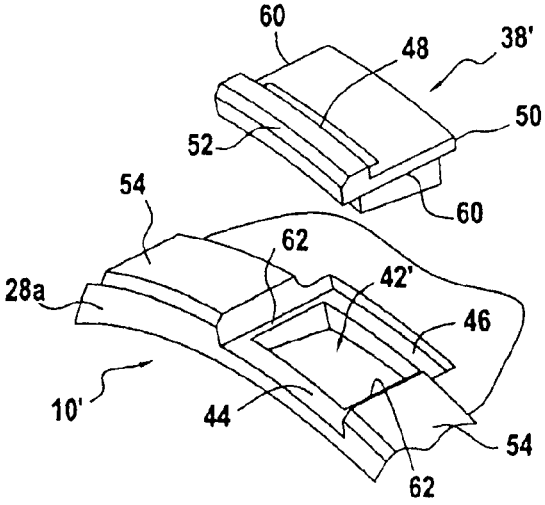
FIG. 5 is a partial, perspective and exploded view of a compressor according to another embodiment of the invention.

As compared with the embodiment described earlier, the air injectors 38' of the compressor 10' partly illustrated in FIG. 5 have the particularity of including side rims (or spoilers) 60 which connect the downstream rim 50 to the upstream rim 52 of the injectors. These side rims each have an inner surface which radially bears against a side rim 62 of the corresponding recess 42' of the first housing 28*a*.

By the presence of these side rims in addition to the upstream 52 and downstream 50 rims, it is possible to avoid any form of parasitic introduction of air intended for the injection through a route other than the one defined by the internal air injection channels 48 of the air injectors 38'.

The invention claimed is:

1. A turbine engine compressor comprising:

a first housing forming a support of injectors centered on a longitudinal axis of the compressor and delimiting on an outside an outflow jet of a gas flow crossing the compressor;

a second housing centered on the longitudinal axis of the compressor and positioned around the first housing by arranging with the first housing an annular space; and a plurality of air injectors each mounted in recesses of matching shape formed at an upstream longitudinal end of the first housing and regularly spaced apart from each other, each air injector comprising:

at least one internal air injection channel opening out radially on one side of the outflow jet of the gas flow crossing the compressor and on the other side into the annular space formed between the housings, and at an upstream longitudinal end, an upstream rim having an inner surface radially bearing against an upstream rim of the corresponding recess of the first housing and an outer surface radially bearing against an inner surface of the second housing; and means for clamping the upstream rim of the air injectors between the housings to maintain the air injectors in position in the recesses of the first housing.

2. The compressor according to claim 1, wherein the first housing comprises bosses formed between the recesses and the outer surface of which protrudes relatively to the outer surface of the first housing and is set back relatively to the outer surface of the upstream rims of the air injectors, the clamping means comprising at least one fixing screw that radially crosses the second housing and that is screwed onto one of the bosses of the first housing.

3. The compressor according to claim 1, wherein each air injector further comprises at one downstream longitudinal end, a downstream rim comprising an inner surface radially bearing against a downstream rim of the corresponding recess of the first housing.

4. The compressor according to claim 3, wherein each air injector further comprises side rims connecting the upstream rim to the downstream rim, these side rims each having an inner surface radially bearing against a side rim of the recess of the corresponding first housing.

5. The compressor according to claim 1, further comprising an annular diffusion conduit centered on the longitudinal axis of the compressor, positioned around the second housing and into which opens out the annular space formed between the housings.

6. The compressor according to claim 1, forming a high pressure compressor.

7. A turbine engine comprising at least one compressor according to claim 1.

* * * * *